United States Patent [19]

Theurer

[11] 4,170,942

[45] Oct. 16, 1979

[54] MOBILE LEVELING, LINING AND BALLAST PACKING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 832,438

[22] Filed: Sep. 12, 1977

[30] Foreign Application Priority Data

Oct. 4, 1976 [AT] Austria ..... 7379/76

[51] Int. Cl.[2] ..... E02B 35/08

[52] U.S. Cl. ..... 104/7 B; 33/287; 104/8; 104/12

[58] Field of Search ..... 104/7 R, 7 B, 8, 12; 33/1 Q, 287, 338

[56] References Cited

U.S. PATENT DOCUMENTS

| | | | |
|---|---|---|---|
| 3,149,578 | 9/1964 | Plasser et al. | 104/12 X |
| 3,240,160 | 3/1966 | Blix et al. | 33/338 X |
| 3,482,527 | 12/1969 | Helgemeir | 104/8 |
| 3,610,157 | 10/1971 | Plokhotsky et al. | 104/12 |
| 3,750,299 | 8/1973 | Plasser et al. | 104/8 X |
| 3,811,382 | 5/1974 | Buchter et al. | 104/12 X |
| 3,821,933 | 7/1974 | Plasser et al. | 104/8 |

FOREIGN PATENT DOCUMENTS

| | | | |
|---|---|---|---|
| 1173923 | 7/1964 | Fed. Rep. of Germany | 104/8 |

*Primary Examiner*—L. J. Paperner
*Attorney, Agent, or Firm*—Kurt Kelman

[57] ABSTRACT

A mobile leveling, lining and ballast packing machine for the non-stop correction of a track comprises a pair of elongated vibratory ballast compacting plates extending along the tie ends at each side of the track and arranged cooperatively to compact the ballast therebetween, a fine correction track lifting and lining unit between the plates, a coarse correction track lifting and lining unit forwardly of the fine correction unit, a first ballast plow and shaping unit associated therewith for moving ballast inwardly from the tie ends during operation of the coarse correction unit, a second ballast plow and shaping unit rearwardly of the fine correction unit, and ballast tampers compacting ballast against the tie ends rearwardly of the second ballast plow and shaping unit. A stationary reference system controls the track correction and includes a series of marker posts mounted along the track, a tensioned reference line supported on the posts, and elements releasably holding the tensioned reference line and for adjusting its vertical and lateral position whereby respective reference line sections may be readily mounted, dismounted and adjusted during movement of the machine. A sensor unit is associated with the correction unit and cooperates with, and senses, the tensioned reference line.

8 Claims, 8 Drawing Figures

MOBILE LEVELING, LINING AND BALLAST PACKING MACHINE

The present invention relates to a mobile leveling, lining and ballast packing machine for the non-stop correction of a track, and more particularly to improvements in such a machine which comprises the combination of an arrangement for compacting ballast in a transverse direction from the ends of the ties towards the points of intersection with the rails and towards the cribs, which arrangement includes an elongated vibratory plate extending along the tie ends at each side of the track and arranged cooperatively to compact the ballast therebetween to provide a region of compacted ballast extending transversely of the track, a fine correction track lifting and lining unit arranged in this region for holding the track in a selected position, the elongated vibratory plates being transversely adjacent the unit, a coarse correction track lifting and lining unit arranged forwardly of the fine correction unit, a first ballast plow and shaping unit arranged in association with the coarse correction unit for moving ballast transversely inwardly from the tie ends during operation of the coarse correction unit, a second ballast plow and shaping unit arranged rearwardly of the fine correction unit, and an arrangement for compacting ballast against the tie ends mounted rearwardly of the second ballast plow and shaping unit. In such machines, at least one of the track lifting and lining units preferably comprises a magnetic rail clamp gliding along the track during the non-stop correction operation and, to remove any ballast off the rails, a brush unit may be associated with at least one of the ballast plow and shaping units.

A machine of this type has been disclosed in U.S. Pat. No. 3,610,157 dated Oct. 5, 1971, which differs fundamentally from the commonly used mobile track tampers operating with tamping tools immersed in the ballast and reciprocated to tamp the ballast under the ties, particularly at the points of intersection between the ties and rails. Such tampers advance intermittently from tamping station to tamping station, stopping at each station to permit immersion of the tamping tools in the ballast.

Naturally, the non-stop machine operates faster than the intermittently advancing machine but accuracy in the track correction requires the operator to stop from time to time to obtain suitable reference parameters since no useful reference system is available to make accurate lining and leveling possible in an uninterrupted operation. In view of the considerably larger forces to which the track is subjected in the non-stop machine than in the intermittently advancing tamper, a suitable reference system is not simple to design. Light or like reference beams, for instance, are too sensitive for the rapid passage of the machine during operation.

It has also been proposed first to lift the track and then to move ballast under the ties in one pass, the ballast being smoothed over the entire bed before the track is lowered again and a vibratory downward pressure is exerted upon the smoothed ballast bed in an effort to compact the ballast. However, this track surfacing method has not been used commercially because it has apparently not been possible to obtain adequate compaction of the ballast over such a relatively large support surface, compared to the tamping method wherein the ballast is compacted only at the points of intersection of ties and rails.

It is the primary object of this invention to improve on the type of non-stop leveling, lining and ballast packing machine first described hereinabove in an effort to increase the working speed of the machine while, at the same time, assuring satisfactory ballast compaction and accurate track correction so that the surfacing meets high standards of ballast tamping and correction.

The above and other objects are obtained by the invention by combining with a machine of the indicated type a stationary reference system determining a desired leveled and lined track position and controlling the track correction by the lifting and lining units, which reference system includes a series of stationary marker posts mounted along the track, a tensioned reference line supported on the posts and means on each of the posts releasably holding the tensioned reference line and for adjusting the vertical and lateral position of the held reference line whereby respective sections of the reference line between successive ones of the posts may be readily mounted, dismounted and adjusted during the movement of the machine. A sensor unit is associated with at least one of the correction units and cooperates with, and senses, the tensioned reference line.

By installing an otherwise known rigid or flexible reference element, such as a reference wire, for rapid mounting and dismounting and adjusting, the machine is capable of achieving much higher quality track correction. More particularly, this arrangement has the advantage of cutting down on stop-and-go intervals in the operation since the tensioning, fastening and adjusting elements for the reference line on the successive marker posts make it possible to produce a relatively long reference line while sections thereof may be rapidly exchanged or adjusted while the surfacing work continues non-stop. Furthermore, such a tensioned reference line as a wire, for example, provides a trouble-free reference for the relatively rough operation of this type of track surfacing machine, which often is unattainable with more complex systems. With a long reference line and an uninterrupted passage of the machine, it is possible to obtain a uniformly compacted ballast support of long duration for the track since errors due to intermittent operation are avoided.

The above and other objects, advantages and features of the present invention will become more apparent from the following detailed description of certain now preferred embodiments thereof, taken in conjunction with the accompanying schematic drawing wherein FIG. 1 is a side elevational view of a mobile leveling, lining and tamping machine incorporating the reference system of this invention;

Figure 1:
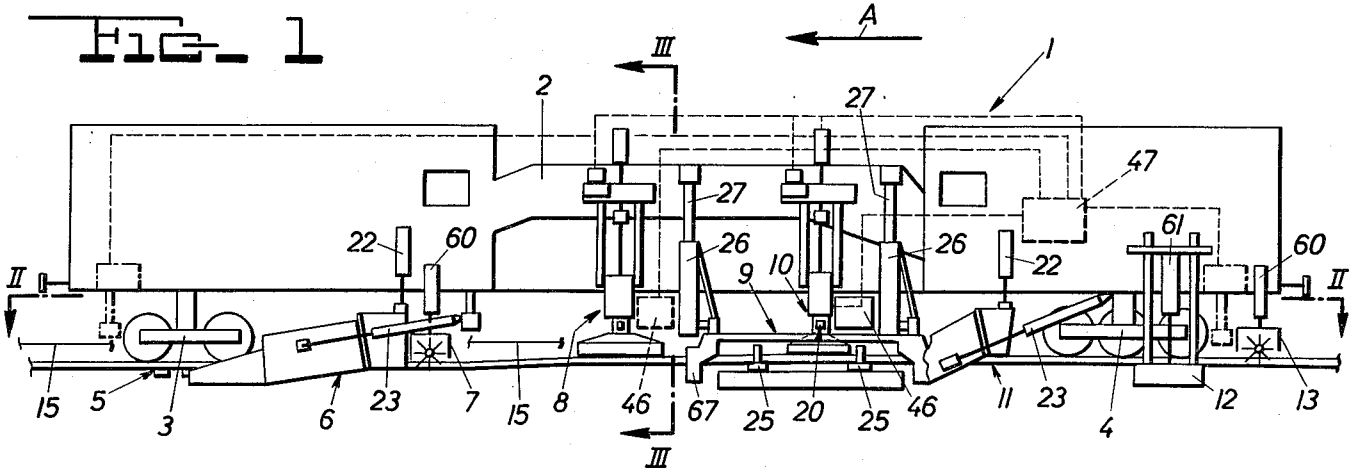
Figure 2:
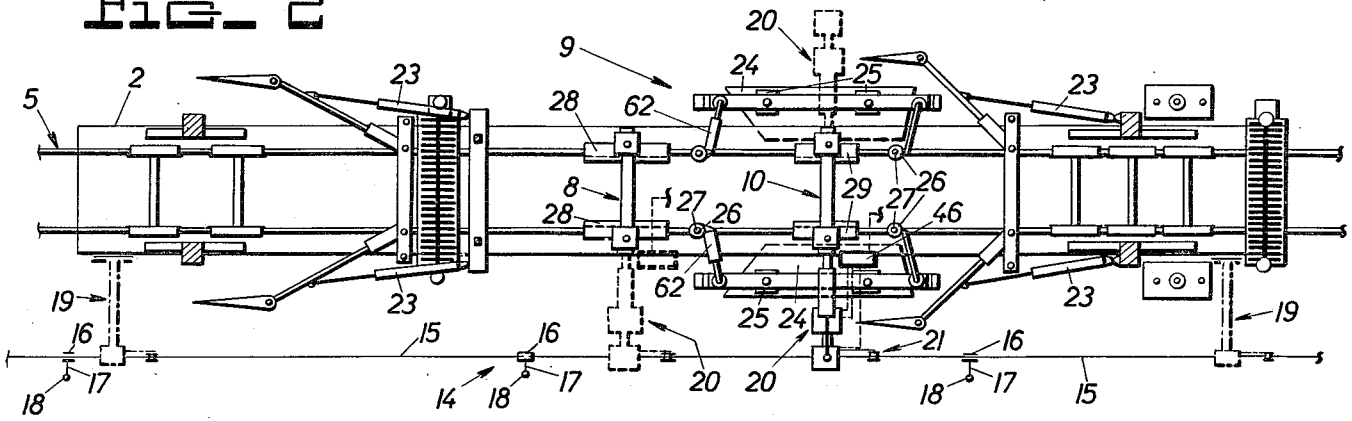
FIG. 2 is a partial top view of the machine of FIG. 1, with the essential operating parts, taken along line II—II of FIG. 1.

Referring now to the drawing and first to FIGS. 1 and 2, there is shown mobile leveling, lining and ballast packing machine 1 for the non-stop correction of track 5 consisting of two rails fastened to ties resting on ballast and defining cribs therebetween (not shown). The machine comprises frame 2 mounted on undercarriages 3 and 4 for mobility on track 5. First ballast plow and shaping unit 6, with brush unit 7, is arranged forwardly of, and in association with, coarse correction track lifting and lining unit 8. Arrangement 9 for compacting the ballast in a transverse direction from the ends of the ties towards the points of intersection and the cribs is disposed rearwardly of coarse correction unit 8. Ballast compacting arrangement 9 includes elongated vibratory plate 24 extending along the tie ends at each side of the track and arranged cooperatively to compact the ballast therebetween to provide a region of compacted ballast extending transversely of the track. Fine correction track lifting and lining unit 10 is arranged in this region for holding the track in a selected position, elongated vibratory plates 24 being transversely adjacent unit 10. Also mounted between the undercarriages is second ballast plow and shaping unit 11 arranged rearwardly of fine correction unit 10. Lateral ballast compacting unit 12 is mounted adjacent rear undercarriage 4 at each side of the track to tamp the ballast against the tie ends. Another brush unit 13 is mounted behind the ballast compacting unit 12.

The machine operates in the direction of arrow A and all references to front- or rearward relations refer to this direction.

All of this structure is conventional and, therefore, not described and illustrated in detail.

FIG. 2 more clearly shows the stationary reference system 14 which determines a desired leveled and lined position of track 5 and which controls the track correction by lifting and lining units 8 and 9. Reference system 14 includes a series of stationary marker posts 18 mounted along the track on at least one side thereof and a tensioned reference line constituted in the embodiment of FIG. 2 by wire 15. The position of reference wire 15 is fixed in a vertical and lateral direction by tensioning and fastening elements 16 which releasably hold the wire, members 17 for vertically and laterally adjusting the position of the held reference line mounting elements 16 adjustably on posts 18. This mounting is illustrated more clearly in FIGS. 3 and 4 which will be described hereinafter.

To sense the position of machine frame 2 and of track correction lifting and lining units 8 and 10, as well as of track 5 whereon the machine frame moves, relative to reference wire 15, a sensor unit 20 is associated with each track correction unit in the illustrated embodiment and a like sensor unit 19 is mounted on the frame at respective ends thereof. Each sensor unit has a sensing element 21 which cooperates with, and senses, reference line 15. The sensing element is guided by the reference line for lateral and vertical movement therewith. As has been indicated in broken lines in FIG. 2, the provision of sensor units 19 and sensor unit 20 associated with the coarse track correction unit 8 is optional, although preferred, and as also indicated in broken lines, another sensor unit may be provided at the other side of the track for cooperating with a reference line mounted there to enable working from either side and changing over quickly from one side to the other.

As shown, first and second ballast plow and shaping units 6 and 11 are mounted on machine frame 2 by hydraulic motors 22 to enable these units to be vertically adjusted to produce a desired ballast bed level. The individual plow blades are pivotal into desired positions by hydraulic motors 23 so as to provide a desired shape of the bed. Brush units 7 and 13 are similarly mounted on the machine frame for vertical adjustment by hydraulic motors 60 and a like hydraulic motor 61 mounting the lateral ballast tampers 12 for vertical adjustment on machine frame 2.

Ballast compacting arrangement 9 includes a pair of elongated vibratory plates 24 which are also mounted on machine frame 2 for vertical movement in relation thereto, the plates being affixed to hydraulic cylinders 26 which are movable under hydraulic fluid pressure along vertical guide columns 27 mounted on the machine frame. Hydraulic motors 62 are linked, respectively, to a bracket on cylinders 26 and to mounting 67 for plates 24 to enable the plates to be pressed in a transverse direction from the ends of the ties towards the points of intersection of the ties and rails and towards the cribs to move ballast inwardly under the ties towards the center of the track. Vibrators 25 are mounted on plates 24 to vibrate the plates during their compacting movement and thereby to facilitate and reinforce the same.

Figure 3:
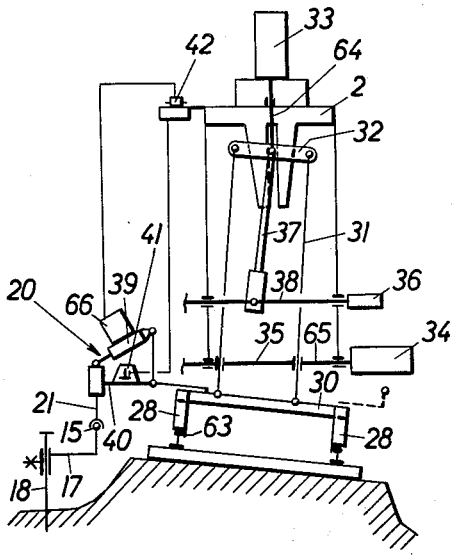
FIG. 3 is a highly schematic cross section taken along line III—III of FIG. 1 and illustrating the track lifting and leveling unit.

In the embodiment illustrated in FIGS. 1 to 3, the track lifting and lining units comprises magnetic clamps 28 and 29, respectively, for holding the track rails for lifting and lining. The magnetic clamps may be solenoids or permanent magnets. As shown, magnets 28 and 29 differ only in length which is adapted to the lifting and lining force of the unit. A larger force being required for coarse lining with unit 8 than with fine lining with unit 10, the magnet rods 28 are longer than rods 29.

The illustrated arrangement of a sensor unit associated with each track correction unit and additional sensor units mounted at the machine ends give the operator excellent control for the entire operation so that, as the machine advances relatively rapidly along the track, small corrections can be made at all times by suitable control of the respective units. The end sensors give the operator a comparative control for adjusting the track correction units.

One embodiment of the structure and operation of the track correction lifting and lining units, with their sensor units, is illustrated in FIG. 3. As shown, magnets 28 are affixed to transverse carrier beam 30 which is linked to parallelogram linkage 31 which includes T-shaped lever 32 whose arm 37 extends downwardly towards beam 30. The beam has flanges 63 which extend into lateral engagement with the rail heads so that lateral lining forces are transmitted from the transverse beam to the track rails. Beam 30 of the lifting and lining unit is vertically movable by hydraulic drive 33 mounted on machine frame 2 and whose piston rod 64 is linked to the center of T-shaped lever 32. Lateral movement of the lifting and lining unit beam is effected by hydraulic drive 34 also mounted on the machine frame and whose piston rod 65 is linked to linkage 31 by push rod 35. Drives 33 and 34 are used, respectively, for leveling and lining the track. Another hydraulic drive 36 operates another push rod 38 which is pivoted to arm 37 of T-shaped lever 32, the pivot of push rod 38 being vertically guided in arm 37 so that lever may be pivoted in a plane extending transversely to track 5, thus adjusting parallelogram linkage 31 and moving transverse beam 30 into a desired inclination with respect to the horizontal, i.e., to any superelevation the track may have.

Sensor unit 20 is carried by the transverse beam of the lifting and lining unit and comprises sensing element 21 mounted on pivotal arm 40 operated by hydraulic motor 39. Inclinometer 41 is mounted on the pivotal arm to measure the superelevation and to produce a corresponding control signal. The sensing element has a suitable wire engaging member which encompasses reference wire 15 so as to be able to follow it vertically as well as laterally, i.e., to sense the position of the reference in any direction. The sensing element preferably has conventional pick-up devices which separately respond to the lateral and vertical position of the reference wire and emit separate signals for any lateral or vertical position correction determined by the position of the reference wire, such control signals being transmitted respectively to drives 34 or 33 for lining and lifting the track until it has assumed a position determined by reference line 15. Such track correction controls are conventional per se. The cylinder of hydraulic motor 39 is mounted on carrier 66 which is in fixed connection with transverse beam 30 and this motor is operated by servo valve 42 which is carried on machine frame 2 and which is, in turn, controlled by signals from inclinometer 41. In this manner, servo valve 42 will operate motor 39 so that the motor will always keep pivotal arm 40 of sensing element 21 in a horizontal position so that the vertical and lateral position of reference wire 15 may always be sensed accurately, independently of the superelevation of the track.

Figure 4:
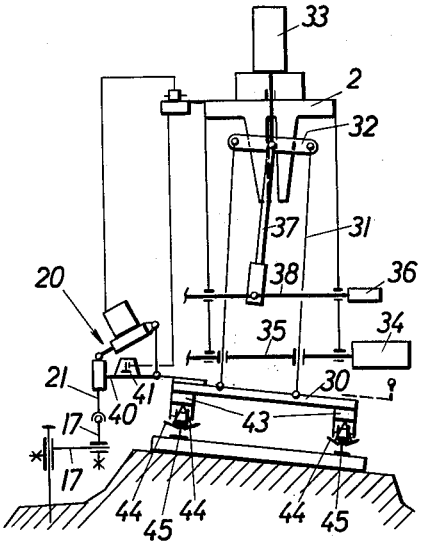
FIG. 4 is a similar view showing a modification of such a unit.

In essence, the modification illustrated in FIG. 4 corresponds to the embodiment of FIG. 3, like reference numerals indicating like parts operating in a like manner in both figures. In this modification, however, the magnetic rail clamps are replaced by mechanical rail clamps of a generally conventional type. The transverse beam of the track correction lifting and lining unit as a carrier part 43 in vertical alignment with each track rail. Each carrier part mounts a pair of lifting rollers 44 arranged to be pivoted into an operating position wherein the flanges of the rollers subtend the rail head and a lining roller 45 whose flanges engage the sides of the rail head.

In the embodiments of FIGS. 3 and 4, the tensioning and fastening elements for wire 15 are mounted on adjustment members 17 which are mounted on marker posts 18 for vertical and lateral movement with respect thereto. Posts 18 are stationary and may simply be driven into the ground at predetermined fixed points along the right of way. The adjustment member has a part which is vertically adjustable on the post and may be fixed thereon in any adjusted position while another part of the member is laterally adjustably mounted on the vertically adjustable part and also may be fixed in any adjusted position, thus making it readily possible to adjust the position of the reference wire held by the tensioning and fastening element on the laterally adjustable part.

Figure 8:
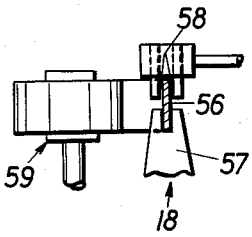
FIG. 8 illustrates another embodiment thereof.
Figure 6:
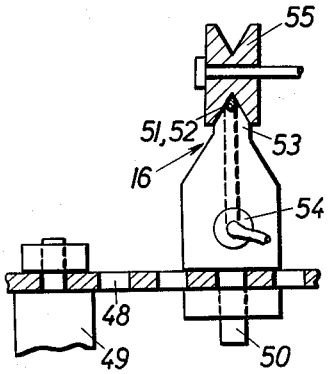
FIGS. 6 and 7 show details of one embodiment of a reference line and its mounting on a marker post, in cooperation with a sensing element.
Figure 7:
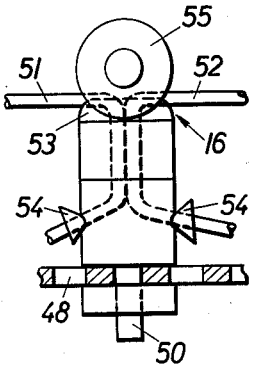

Preferred embodiments of tensioning and fastening elements are shown in FIGS. 6 to 8 to enable the reference line to be held releasably and to tension the line whereby respective sections of the reference line between successive marker posts 18 may be readily mounted, dismounted and adjusted during the movement of the machine.

In the embodiment of FIGS. 6 and 7 respectively showing end and side views, partly in section, the marker poster is constituted by a so-called fixed point 49, which is a reference point located laterally of the track. Perforated plate 48 is affixed to fixed post 49 and has a plurality of bores at predetermined distances from each other, each of the bores being capable of receiving pin 50 of fastening and tensioning element 16 for wire 15. Element 16 may be placed with its pin 50 in a selected bore of carrier plate 48. The fastening and tensioning element defines a slotted guide 53 for receiving ends 51 and 52 of sections of the wire 15 extending between successive marker posts, which wire ends are clamped in the guide and, after suitable tensioning of the wire section, are releasably held in position on element 16 by means of conical fixinf wedges 54. As best shown in FIG. 6, the top of the fastening and tensioning element 16 is so shaped as to conform to the V-shaped groove or sensing roller 55 which constitutes the sensing element. The flanges of roller 55 define contact faces engaging reference wire 15 so that the wire will be effectively sensed as the roller passes from one end 51 to the next end 52 of the reference (see FIG. 7). Such a rolling sensing element pivotally mounted in the manner shown in FIGS. 3 and 4 to adjust for any superelevation will effectively sense all vertical and lateral positions of the reference line in a trouble-free manner even when the machine advances non-stop at relatively high speed.

In the embodiment of FIG. 8, the tensioned reference line is a vertically arranged steel band 56 tensioned to constitute a ruler which the sensor unit senses. This embodiment is particularly useful for leveling operation since a vertically arranged steel band will not substantially sag when tensioned and will thus provide a very accurate reference for leveling and lining even when the marker posts are spaced relatively far apart. The steel band is guided and held in a slot in fastening element 57 mounted on post 18 and its positioned is sensed with a fork-like sensing element which may have, as shown, a pair of contact faces 58 wherebetween the vertical steel band is engaged. For releasably holding the tensioned steel band, reeling device 59 is provided for reeling the band up. In this manner, the steel band reference can be readily installed and removed.

The operation of the mobile leveling, lining and ballast packing machine will partly be obvious from the above description of the structure thereof and will be further elucidated hereinbelow.

The machine may be self-propelled or pulled by a locomotive in the direction of arrow A. As machine 1 advances non-stop along track 5, first ballast plow and shaping unit 6 will push ballast from the sides of the ballast bed into the region of the track ties. If desired or necessary, additional ballast may be stored at the sides of the track before the work begins so as to provide more ballast for compaction between the tie ends. As plow and shaping unit 6 pushes the ballast inwardly, it simultaneously digs a ditch along both sides of the track for succeeding elongated vibratory ballast compaction plates 24. Any ballast moved onto the rails by unit 6 is removed therefrom by brush unit 7 so that solenoids 28 and 29 may make trouble-free contact with the rails and hold them securely during the leveling and/or lining operations. During the non-stop advance of machine 1, coarse correction unit 8 will coarsely correct the position of track 5 and elongated vibratory plates 24 will subsequently compact the ballast under the ties of the coarsely corrected track. The vibratory plates may be arranged at a slight angle with respect to the track and, held against outward movement by motors 62 and strongly vibrated by vibrators 25, they will press the accumulated ballast with considerable force under the ties and particularly under the points of intersection between the ties and rails, as well as into the cribs defined between the ties. Simultaneously, track 5 is fine corrected by unit 10 which holds the track in the position determined by reference line 15, the packed ballast under the ties fixing the corrected track in its position and reference system 14 in cooperation with sensor unit 20 controlling the correction.

The ballast compaction and track correction produced by machine 1 is particularly effective if the machine is operated non-stop over a track section of considerable length since this will avoid repeated inward pivoting of vibratory compacting plates 24 by motors 62 and will assure uniform ballast compaction over the entire, long track section. This will also produce a uniform grade and line and will avoid spot settling of the track under the operating loads of trains passing later over the corrected track.

Figure 5:
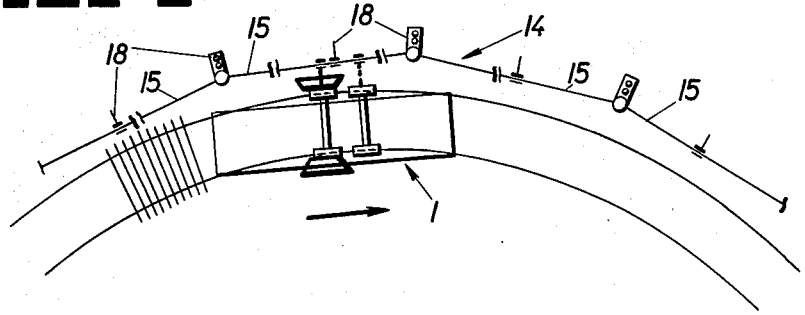
FIG. 5 is a schematic top view illustrating the cooperation of a reference line according to the invention with the machine.

FIG. 5 diagrammatically shows how reference system 14 permits machine 1 to operate non-stop over long track sections, including curves. Marker posts 18 are stationarily mounted along the track and sections of reference line 15 are releasably held on the posts and the position of the reference line is laterally and vertically adjustable according to a desired track path by operation of adjustment members 17. The reference line position is continuously sensed by sensor units 19 and 20 and corresponding leveling and lining signals are transmitted separately from the sensors to control 46 (see FIG. 1) whose output signals operate solenoid valves controlling leveling drive 33 and lining drive 34 so that the track is moved into a position determined by reference line 15. The correction parameters, including the signals from sensors 19, with which the position of machine frame 2 in relation to reference line 15 is determined to supervise the operation of track correction units 8 and 10, are fed by a control circuit to central control unit 47 so that track survey and control parameters may be obtained and, if desired, recorded for controlling any or all of the operating units of the machine.

If desired, it is also possible to store in central control unit 47 signals for predetermined amounts of excess leveling and/or lining, which are sometimes used in track correction operations to enable the track to settle back to the desired level and/or line after the operation has been completed and traffic begins to move over the corrected track. It is also possible to use control 46 and/or central control unit 47 for the correction of track curves and transition curves with respect to the polygonal reference 14 (see FIG. 5), all control signals being transmitted to drives 33, 34 and 36 of track lifting and leveling units 8 and 10. Sensing elements 21 may be adjusted by moving sensor units 19 and 20 with respect to their fixed supports 2 and 30, respectively, or by moving the sensing elements with respect to the sensors. At any rate, it is important for the formation of a continuous reference line 15, which should be as long as possible to enable the non-stop operation of the machine to proceed rapidly, to make certain that the transitions between the individual reference line sections are smooth so as to enable the sensing elements to sense the position of the reference line flawlessly at all points of the line. FIGS. 6 to 8 illustrate useful means for releasably holding the tensioned reference line and for adjusting its vertical and lateral position so that the sensors remain in reliable sensing contact with the reference line throughout its length.

It is possible to mount reeling devices for a steel band reference line at a rear end of the machine or a succeeding bogie to make it possible to roll up the band rapidly after a track section has been corrected and/or to mount the reference line rapidly before the machine begins its correction operation by preceding it with a mobile reeling apparatus.

Also, while a wire or steel band has been described and illustrated as reference line, other such lines, for example rods and the like, may be used. Furthermore, the hydraulic motors may be replaced, if desired, by threaded spindle drives which may be operated by electric motors. Various structural embodiments of sensor units capable of sensing the position of a reference line may be used, such as sensing rollers, gliding elements, forks and the like, which may be associated with pick-up devices for producing control signals responsive to the sensed reference line position, such as potentiometers, voltage converters and the like. Also, instead of using the control signals for the direct control of the track lifting and lining units 8 and 10, these signals may be used to control the position of the end points of an additional reference line moving with the advancing machine, which additional reference line is then used to control the track correction. Instead of moving the lifting and lining units relative to machine frame 2 to effectuate track correction, these units may be mounted stationarily on the frame and the entire frame may be moved with respect to the undercarriages for correcting the track position. To prevent differences in the track gauge from producing erroneous control signals, it is important that at least the sensor units be in play-free engagement with the grade rail.

What I claim is:

1. A mobile leveling, lining and ballast packing machine for the non-stop correction of a track consisting of two rails fastened to ties resting on ballast and defining cribs therebetween, the ties having ends projecting laterally from the rails and points of intersection with the rails between the ends, the machine comprising the combination of (a) an arrangement for compacting the ballast in a transverse direction from the ends of the ties towards the points of intersection and the cribs, the arrangement including an elongated vibratory plate extending along the tie ends at each side of the track and arranged cooperatively to compact the ballast therebetween to provide a region of compacted ballast extending transversely of the track, (b) a fine correction track lifting and lining unit arranged in said region for holding the track in a selected position, the elongated vibratory plates being transversely adjacent the unit, (c) a coarse correction track lifting and lining unit arranged forwardly of the fine correction unit, (d) a first ballast plow and shaping unit arranged in association with the coarse correction unit for moving ballast transversely inwardly from the tie ends during operation of the coarse correction unit, (e) a second ballast plow and shaping unit arranged rearwardly of the fine correction unit, (f) an arrangement for compacting ballast against the tie ends mounted rearwardly of the second ballast plow and shaping unit, (g) a stationary reference system determining a desired leveled and lined track position and controlling the track correction by the lifting and lining units, the reference system including (1) a series of stationary marker posts mounted along the track, (2) a tensioned reference wire supported on the posts and (3) means on each of the posts for releasably holding the tensioned reference line and for adjusting the vertical and lateral position of the held reference line whereby respective sections of the reference line between successive ones of the posts may be readily mounted, dismounted and adjusted during the movement of the machine, and (h) a sensor unit associated with at least one of the correction units and cooperating with, and sensing, the tensioned reference line.

2. The mobile leveling, lining and ballast packing machine of claim 1, further comprising a brush unit associated with at least one of the ballast plow and shaping units for brushing off any ballast moved by the unit onto the rails.

3. The mobile leveling, lining and ballast packing machine of claim 1, wherein at least one of the track lifting and lining units comprises a magnetic rail clamp.

4. The mobile leveling, lining and ballast packing machine of claim 1, wherein one of said sensor units is associated with each of the correction units, each of the correction units including respective drives for lifting and lining the track, and the sensor units being arranged to control the drives.

5. The mobile leveling, lining and ballast packing machine of claim 4, comprising a further sensor unit at an end of the machine.

6. The mobile leveling, lining and ballast packing machine of claim 1, wherein the sensor unit is mounted pivotally and comprises a rolling sensing element having contact faces engaging the tensioned reference wire.

7. The mobile leveling, lining and ballast packing machine of claim 6, wherein the rolling sensing element has flanges defining the contact faces.

8. A mobile leveling, lining and ballast packing machine for the non-stop correction of a track consisting of two rails fastened to ties resting on ballast and defining cribs therebetween, the ties having ends projecting laterally from the rails and points of intersection with the rails between the ends, the machine comprising the combination of (a) an arrangement for compacting the ballast in a transverse direction from the ends of the ties towards the points of intersection and the cribs, the arrangement including an elongated vibratory plate extending along the tie ends at each side of the track and arranged cooperatively to compact the ballast therebetween to provide a region of compact ballast extending transversely of the track, (b) a fine correction track lifting and lining unit arranged in said region for holding the track in a selected position, the elongated vibratory plates being transversely adjacent the unit, (c) a coarse correction track lifting and lining unit arranged forwardly of the fine correction unit, (d) a first ballast plow and shaping unit arranged in association with the coarse correction unit for moving ballast transversely inwardly from the tie ends during operation of the coarse correction unit, (e) a second ballast plow and shaping unit arranged rearwardly of the fine correction unit, (f) an arrangement for compacting ballast against the tie ends mounted rearwardly of the second ballast plow and shaping unit, (g) a stationary reference system determining a desired leveled and lined track position and controlling the track correction by the lifting and lining units, the reference system including (1) a series of stationary marker posts mounted along the track, (2) a vertically arranged steel band tensioned to constitute a reference ruler supported on the posts and (3) means on each of the posts for releasably holding the tensioned steel band and for adjusting the vertical and lateral position of the held steel band whereby respective sections of the steel band between successive ones of the posts may be readily mounted, dismounted and adjusted during the movement of the machine, the holding means comprising a reeling device vertically and laterally adjustably mounted on the posts for reeling the tensioning the steel band, and (h) a sensor unit associated with at least one of the correction units and cooperating with, and sensing, the tensioned steel band.

* * * * *